US012478089B2

(12) United States Patent
Soriano et al.

(10) Patent No.: US 12,478,089 B2
(45) Date of Patent: Nov. 25, 2025

(54) WHITE SNUS WITH TOBACCO TASTE

(71) Applicant: JT International SA, Geneva (CH)

(72) Inventors: Miguel Soriano, Geneva (CH); Theo Verlaan, Geneva (CH)

(73) Assignee: JT International SA (CH)

( * ) Notice: Subject to any disclaimer, the term of this patent is extended or adjusted under 35 U.S.C. 154(b) by 376 days.

(21) Appl. No.: 18/029,759

(22) PCT Filed: Oct. 15, 2021

(86) PCT No.: PCT/EP2021/078594
§ 371 (c)(1),
(2) Date: Mar. 31, 2023

(87) PCT Pub. No.: WO2022/079230
PCT Pub. Date: Apr. 21, 2022

(65) Prior Publication Data

US 2023/0363437 A1 Nov. 16, 2023

(30) Foreign Application Priority Data

Oct. 15, 2020 (EP) ..... 20201939

(51) Int. Cl.
*A24B 13/00* (2006.01)
*A24B 15/18* (2006.01)
*A24B 15/30* (2006.01)

(52) U.S. Cl.
CPC ..... *A24B 13/00* (2013.01); *A24B 15/183* (2013.01); *A24B 15/30* (2013.01)

(58) Field of Classification Search
CPC ..... A24B 13/00; A24B 15/183
See application file for complete search history.

(56) References Cited

U.S. PATENT DOCUMENTS

| | | | | |
|---|---|---|---|---|
| 2010/0242978 | A1* | 9/2010 | Fuisz | A24B 15/00 131/352 |
| 2012/0055494 | A1 | 3/2012 | Hunt et al. | |
| 2013/0206153 | A1 | 8/2013 | Beeson et al. | |
| 2015/0296868 | A1 | 10/2015 | Sutton | |
| 2017/0188622 | A1 | 7/2017 | Wilson | |
| 2018/0271139 | A1 | 9/2018 | Aspgren et al. | |
| 2018/0310623 | A1* | 11/2018 | Batista | A24C 5/01 |
| 2019/0269170 | A1* | 9/2019 | White | A24B 15/165 |
| 2020/0297024 | A1 | 9/2020 | Bodin | |

FOREIGN PATENT DOCUMENTS

| | | | |
|---|---|---|---|
| JP | 2015536688 | A | 12/2015 |
| JP | 2020156423 | A | 10/2020 |

OTHER PUBLICATIONS

International Search Report for Application No. PCT/EP2021/078594 mailed Jan. 18, 2022, pp. 1-4.

* cited by examiner

*Primary Examiner* — Michael H. Wilson
*Assistant Examiner* — Ronnie Kirby Jordan
(74) *Attorney, Agent, or Firm* — Lerner David LLP

(57) ABSTRACT

A white snus with sachet material, preferably a pouch, which is not moisturized during the manufacturing process, includes a filler material, a nicotine source and flavorings, wherein the flavorings include tobacco particles having a size ($sD_{50}$ laser diffraction)≤30 μm adhered on an inert carrier. A method for manufacturing a white snus includes the steps of providing filler material, providing a nicotine source, providing tobacco particles having a size ($sD_{50}$ laser diffraction)≤30 μm adhered on a carrier, providing further flavorings, optionally providing further ingredients and mechanically mixing the ingredients. The carrier is inert with respect to the surrounding environment, wherein the carrier itself remains chemically unchanged when contacted by other components of the snus, wherein the nicotine source does not contain tobacco.

17 Claims, No Drawings

WHITE SNUS WITH TOBACCO TASTE

CROSS-REFERENCE TO RELATED APPLICATIONS

The present application is a national phase entry under 35 U.S.C. § 371 of International Application No. PCT/EP2021/078594, filed Oct. 15, 2021, published in English, which claims priority to European Application No. 20201939.4 filed Oct. 15, 2020, the disclosures of which are incorporated herein by reference.

FIELD OF THE INVENTION

The present invention is directed to a white snus comprising a filler material, a nicotine source and flavoring. The flavoring comprises tobacco particles having a size ($sD_{50}$ laser diffraction)≤30 μm adhered on an inert carrier. Furthermore, a method for producing a white snus comprising the steps of providing filler material, providing a nicotine source, providing tobacco particles having a size ($sD_{50}$ laser diffraction)≤30 μm adhered on an inert carrier, providing further flavorings, optionally providing further ingredients and mechanically mixing the ingredients is described.

BACKGROUND

Snus is a smokeless tobacco product which is usually consumed by placement inside the lip between the lip and gums for an extended period. (Brown) snus usually comprises tobacco composition in a pouch. Often the tobacco composition is prepackaged as moist powder in small teabag-like sachets. Snus is often mildly flavored with food-grade bergamot, citrus, juniper berry, herbs and/or floral flavors, as described in US 2012/0055494 A1. In contrast to snuff, the snus tobacco is usually not fermented. In its traditional form, the sachet material is moisturized during the manufacturing process. This results in a brownish appearance of the pouch.

Since the brownish pouch is often considered to appear unhygienic, so-called white snus have become popular. The white snus is usually a milder-tasting and slightly slower-release form. The main difference with respect to the traditional form is that the sachet material is not moisturized during the manufacturing process. The pouch remains dry and discoloration due to diffusion of coloring agents through the pouch material is slowed. Furthermore, even if the tobacco composition within the pouch has the same moisture content, the nicotine and flavor are passing slower through the pouch material. Also nicotine pouches, which are not containing tobacco leaves are considered to be white snus.

However, due to the moisture content of the tobacco composition discoloration of the pouch material often occurs during storage. Thus, it is a subject matter of the present invention to provide a white snus, which do not appear unhygienic after storage over a longer period. Preferably even discoloring of the users teeth due to the color of the tobacco component could be reduced or even avoided.

Furthermore, a method for producing a white snus is requested.

DETAILED DESCRIPTION

It has been found that these problems could be overcome by a white snus according to claim 1 and a method according to claim 11.

A white snus according to the invention comprises sachet material, preferably a pouch, which is not moisturized during the manufacturing process. Furthermore, the white snus comprises a filler material, a nicotine source and flavoring. The flavoring comprises tobacco particles having a size ($sD_{50}$ laser diffraction)≤30 μm adhered on an inert carrier. Surprisingly, it has been found that tobacco particles having such a small size and adhered to the surface of a carrier material are causing less or even no discoloring of the pouch (and/or the user's teeth). Because of the small size, the particles are not visible to the human eye, at least through the pores of the pouch. Furthermore, the small particles have shown to deliver the full tobacco flavor to a user. The full tobacco flavor could be even provided very quickly. The tobacco particles may originate from any part of the tobacco plant, e.g. leaves, stems or roots.

The nicotine source may be tobacco, but the invention is not limited to white snus comprising tobacco as (main) nicotine source. In a preferred embodiment, the tobacco of the nicotine source differs from the kind of tobacco used for producing the small tobacco particles. Since the tobacco flavor is mainly provided (and determined) by the flavor of the small tobacco particles, a cheaper tobacco quality could be used for the nicotine source.

The term "inert", especially in combination with the word "carrier", means in the context of the present invention, that a first substance does not chemically interact with the second substance (e.g. the carrier). An inert carrier is preferably inert with respect to the surrounding environment. Thus, the carrier itself remains chemically unchanged when contacted by other components of the snus, e.g. the nicotine source or the pouch material. However, "inert" does not mean that no interaction between the other components and the (inert) carrier is possible. Especially physical interactions like energy transfer is possible. Also, other physical properties of the inert material (e.g. the carrier) could change due to such an interaction. For example, its shape or (specific) surface area could change because of application of an external force.

Preferably the average size of the tobacco particles ($sD_{50}$ laser diffraction) is ≥1 μm, preferably ≥2.5 μm, more preferably ≥5 μm, most preferably ≥8 μm. It has been found, that grinding of the tobacco particles to a smaller particle size could affect the flavor. It is believed that some of the flavoring molecules of the tobacco decompose during the grinding process due to the high shear energy. Furthermore, some flavoring molecules could exit too small tobacco particles during the grinding process or during a later handling process. This would result in a depletion of these flavoring molecules in the tobacco particles and a flavor different with respect to the full tobacco flavor. Furthermore, it has been found, that larger particles could maintain the full tobacco flavor over a longer period during consumption of the snus.

Tobacco particles having such a small average particle size are providing a high surface area from which flavoring molecules could leave the particle. The particle size of ≤30 am has been found to allow transfer of a plurality of flavoring molecules homogeneously over a long time period. Thus, a full tobacco flavor could be maintained over a long period. The particle size allows migration of bigger and smaller molecules from an internal volume of the particles to their surface from which these molecules could exit and then be tasted by a user. It has been shown that the mean size of the tobacco particles provides an optimal volume to surface ratio, due to which a mixture with widely constant ratios of flavoring molecules leaves the particles over a long time interval.

Since the small tobacco particles provide a full tobacco flavor over a long period, the total amount of tobacco could be reduced. In this embodiment, the snus preferably comprises a nicotine source other than tobacco leaves. Preferably, the nicotine source does not contain tobacco. Preferably, the snus does not contain tobacco leaves and more preferably the tobacco particles having a size≤30 μm adhered on an inert carrier is the only tobacco compound of the snus. Due to the corresponding reduction of the total tobacco content, high taxes or restrictions could be avoided.

Preferably, the amount of dry the tobacco particles is less than 2% (weight/weight) of the dry snus, preferably less than 1%, more preferably in the range of 0.01 to 0.1%. All the previous mentioned percentages are defining the dry weight of the tobacco particles with respect to the dry weight of the entire snus, including the pouch. The term "dry" in this context means, that the weight percentages refer to the dry weight only without any liquid components. Also in the following, any percentages should be understood in this manner, if not explicitly specified differently. It has been shown, that an amount of the tobacco particles in the above-mentioned rage is high enough to provide the full tobacco flavor over a long period. On the other hand, these amounts of the tobacco particles are small enough to reduce or even avoid discoloring of the pouch. Thus, the appearance of the snus remains hygienic.

In a preferred embodiment, a form of the carrier material is selected from a group comprising fibers, filtering material, fiber tow, staple fibers, randomly oriented staple fibers, sheets, paper sheet, folded paper, rolled paper, crimped paper, matrix material, sponge type, ceramic material, fleece, multiple tubes, single tube, granulate, spherical particles, cubes, cuboids and parallelepipeds. These kinds of carrier materials have been found advantageous, since they are commonly used for other purposes in the production of tobacco products. Thus, it is known in the art, how to handle these materials. Furthermore, these materials could be handled with common handling machines.

In a preferred embodiment, the tobacco particles are adhered to an inert carrier comprising cellulose. Since cellulose is a natural product which is frequently used in tobacco industry, it is well tolerated by the user, has no or only little influence on the flavor and could be handled in large quantities with handling machines known in tobacco industry. Preferably the carrier comprises cellulose fibers, powders or granules (or combinations thereof). These forms could be produced and handled easily. Due to the fiber structure of cellulose, a clear differentiation between the terms "fiber", "powder" and "granule" with respect to cellulose products is difficult and often only depends on the length of the fiber (of given diameter). In the meaning of the present invention a fiber should be understood as a particle having a longitudinal extension which exceeds its extension in the width and height direction by a factor of ≥20, preferably ≥50, more preferably ≥100. All these forms of cellulose provide a large surface area (with respect to its volume) which allow adherence of tobacco particles. Thus, the overall density of tobacco particles could be high. This has been found advantageous for delivery of the full tobacco flavor.

Due to the high relative surface area of the small tobacco particles (with respect to their volumes) the tobacco flavor could reach the surface easily and exit the particle. Preferably the tobacco flavor is extractable from the tobacco particles adhered on the inert carrier by saliva. This embodiment is preferred since undesired loss of flavor during storage could be limited.

Preferably, releasing of the flavoring molecules from the tobacco particles is initiable by an activation signal. This embodiment is advantageous, since releasing of the flavoring molecules could be triggered by the user. Thus, depletion of flavoring molecules from the tobacco particles during storage could be avoided. Preferably the activation signal is selected from a group comprising temperature change, mechanical strain, humidity change, change of the pH value, contact to a liquid, contact to water and contact to saliva. Thus, it is possible, that releasing of the flavoring molecules from the small tobacco particles is initiated when the snus is used. Preferably, the extraction of the flavoring molecules from the small tobacco particles is initiated by one or more proteins of the saliva. Preferably, the tobacco particles remain adhered to the inert carrier when contacted by saliva.

In a preferred embodiment, the amount (weight) of the nicotine source in the snus is at least 5-fold, preferably ≥7-fold, ≥10-fold or even ≥20-fold higher than the amount of the small tobacco particles. It has been found, that even small amounts of the small tobacco particles are suitable to provide the full tobacco flavor to a user, even if large amounts of the nicotine source are present. The above-mentioned ratios are preferred since a cheap and/or tobacco free nicotine source could be used and the full tobacco flavor could be maintained anyway. High ratios between the amount of the nicotine source in the snus and the amount of the small tobacco particles are especially preferred if legal restrictions or high taxes limit the acceptance of tobacco leaves as nicotine source in the snus product.

Preferably, the tobacco particles adhered to the inert carrier are obtained by grinding of a tobacco source. Also preferably the tobacco particles comprise chemically metastable flavoring molecules. More preferably the grinding process is performed at reduced temperature of ≤15° C., preferably ≤12° C., more preferably a temperature of 0° to 10° C. The lower temperature avoids decomposition of favoring molecules during grinding.

To avoid decomposing of flavoring molecules during the grinding process, it has been found advantageous, to reduce the viscosity of the grinding composition. This could be achieved by adding a solvent to this composition. Such a solvent (or "dispersion medium") is preferably selected from a group comprising water, monovalent alcohols, polyvalent alcohols, sugar alcohols, sugars and polyvalent alcohol esters. By using such a dispersion medium, the average particle size of the tobacco can be adjusted to the desired value without significant changes of the flavor.

More preferably, the one or more dispersion medium is selected from a group comprising water, monovalent alcohol, monovalent aliphatic alcohol, methanol, ethanol, 1-propanol, 2-propanol, 1-butanol, 2-butanol, 2-methyl-1-propanol, 2,2-dimethylethanol, cyclohexanol, monovalent alcohol having an aromatic substituent, benzyl alcohol, monovalent alcohol containing one or more halogen element monovalent alcohol having one or more ether bond, polyvalent alcohol, glycerol, propylene glycol, sugar alcohol, sorbitol, maltitol, xylitol, erythritol, lactitol, sorbitan, xylose, arabinose, mannose, trehalose, sugar, lactose, sucrose, coupling sugar, glucose, enzyme-saccharified starch syrup, acid-saccharified starch syrup, maltose starch syrup, maltose, isomerized sugar, fructose, reduced maltose, reduced starch syrup, honey, polyvalent alcohol ester, fatty acid polyvalent alcohol ester and fatty acid triglyceride.

Preferably, the ratio of the tobacco particles in a grinding dispersion is ≥0.5% (w/w), preferably ≥1% (w/w), ≥2% (w/w) or ≥5% (w/w), more preferably ≥10% (w/w), most preferably ≥20% (w/w) and ≤95% (w/w), preferably ≤90% (w/w), ≤80% (w/w) or ≤70% (w/w), more preferably ≤60% (w/w), most preferably ≤50% (w/w). It has been found that these ratios allow grinding of the tobacco to the desired average particle size in most of the solvents without significant loss of flavor.

Preferably, the snus comprises further additives. By adding additional substances (or additives) the snus could be adapted to individual preferences of different users. Preferably, the snus comprises at least 2, preferably ≥3, more preferably ≥4, more preferably ≥5, more preferably ≥6 further substances. Preferably these additives are selected from a group comprising a filler material, water, humectants, cellulose, glycol, propylene glycol, glycerol, sweetener, sugar, sugar alcohol, gum, pH-adjusting agent, puffer agent, ammonia, ammonium carbonate, potassium carbonate, sodium carbonate, calcium carbonate, preservative, salt.

It has been found that the water content of the snus is affecting diffusion of coloring and/or flavoring molecules through the snus composition. This diffusion may result in loss of flavor and/or discoloration of the pouch. To reduce or even avoid loss of flavor and/or discoloration, it is preferred that the water content of the snus is ≥15% and preferably in the range of 15-70% (w/w), more preferred in the range of 20-65%, most preferred in the range of 30-60% or. The given weight percentages refer to the whole snus excluding the pouch.

It is however preferred to apply the invention to a dry snus. Dry snus comprise an overall water content of less than 15%. In dry snus the problems related to diffusion will not occur due to the low water content.

In a preferred embodiment, the tobacco particles are pasteurized. This could increase the shelf life of the snus. Preferably the sterilization (the terms "pasteurized" and "pasteurization" are used synonymously with the terms "sterilized" and "sterilization") follows the grinding process. In a preferred embodiment, the sterilization process is performed at elevated temperature. The higher temperature could be used to get rid of the solvent (or dispersion medium) added during the grinding process. The sterilization process could also include the process of adhering the tobacco particles on the carrier.

A further aspect of the invention is a method for manufacturing a white snus comprising the steps of:

providing a filler material,
providing a nicotine source,
providing tobacco particles having a size≤30 μm adhered on an inert carrier,
providing further flavorings,
optionally providing further ingredients,
mechanically mixing the ingredients.

This method allows production of a white snus in an easy manner, which provides a desired tobacco flavor even if this tobacco is not the main nicotine source. Thus, this method allows selection of a desired tobacco flavor independently from an eventually present flavor of the nicotine source. Even snus compositions which originally do not provide a tobacco flavor (e.g. because the nicotine does not derive from tobacco), could be adjusted easily to provide a desired tobacco flavor.

Preferably, the tobacco particles adhered on the inert carrier are added to the mixture of all the other ingredients during mixture of all other ingredients. This variation of the method allows adjustment of the properties of the snus composition independently from its flavor. Preferably properties of the composition selected from a group comprising water content, moisture, viscosity, temperature, and pH value are set to desired values prior adding the tobacco particles adhered on the inert carrier.

Preferably, an intermediate composition is prepared by adhering the tobacco extract on an inert (preferably solid) carrier material. Also preferably, the intermediate composition is prepared by adhering the tobacco particles on the inert carrier material. Such an intermediate composition could comprise further components (or ingredients). Preparing an intermediate composition has been found advantageous, since it could be produced in large quantities and stored over a long period (preferably at gas tight conditions). The same intermediate composition could be used for a plurality of batches of snus compositions. This ensures a (identical) high product quality for a plurality of different batches of snus products.

Adding the tobacco particles adhered on the inert carrier during a very late handling step reduces the risk of loss of flavor or decomposition of flavoring molecules due to following handling steps.

Preferably, the tobacco particles adhered on the inert carrier is added to the mixture of the other ingredients in an amount of less than 2% (weight/weight), preferably less than 1%, more preferably in the range of 0.01 to 0.1%. Usually such a little percentage of the tobacco particles adhered on the inert carrier does not change the properties (e.g. water content, viscosity, temperature, and pH value) of the snus composition much.

Preferably, the method further comprises the step of pasteurizing the tobacco particles adhered on an inert carrier. This step is preferably carried out independently from other ingredients of the snus composition. Preferably, this step is performed prior to adding of the tobacco particles adhered on the inert carrier to the mixture of the other ingredients. The pasteurization step is preferably performed at elevated temperature. This higher temperature could also be used to reduce or remove a solvent from the tobacco particles adhered on the inert carrier.

Reduction or removal of the solvent may also result in adherence of the tobacco particle on a surface of the inert carrier. Thus, the steps of pasteurization and adhering the tobacco particles on the surface of the carrier are performed simultaneously. In this context simultaneously should be understood in that the steps of pasteurization and adhering the tobacco particles on the surface of the carrier overlap each other at least partially. However, one of these steps (preferably the step of adhering the tobacco particles on the surface of the carrier (eventually including removal of a solvent)) could be finished prior the other of these steps. Preferably, no further handling step is performed between these two steps.

In a preferred variation of the method, the tobacco particles adhered on the inert carrier further comprises a humectant. In this embodiment, the tobacco particles adhered on an inert carrier are provided as mixture with a humectant. Such a mixture often provides a lower viscosity and could be handled easier. When adding such a mixture to the mixture of other ingredients of the snus composition, the interaction (e.g. energy transfer due to different temperatures and/or shear force caused by the mixing process) between these ingredients and the tobacco particles could be buffered. This could reduce decomposition of flavoring molecules. Preferably, the humectant is the same humectant as used as one of the further ingredients. In this embodiment the tobacco particles adhered on the inert carrier and the mixture of other ingredients of the snus composition comprise the same humectant, which has been found to be advantageous with respect to the mixing properties. Especially the time required until a homogeneous mixture of all ingredients of the snus composition (including the tobacco particles adhered on the inert carrier) is obtained could be reduced in this embodiment.

It will be understood that the embodiments explained above are merely a first embodiment of the method and/or system of the invention. In this respect, the disclosure of the invention is not limited to these embodiments.

All the features disclosed in the application documents are claimed as being essential to the invention in so far as they are individually or in combination novel over the prior art.

The invention claimed is:

1. A white snus with sachet material which is not moisturized during a manufacturing process, wherein the white snus comprises a filler material, a nicotine source and flavorings, the flavorings comprise tobacco particles having a size≤30 μm adhered on a carrier, wherein the carrier is inert with respect to a surrounding environment, wherein the carrier itself remains chemically unchanged when contacted by other components of the snus, wherein the nicotine source does not contain tobacco.

2. The white snus according to claim 1, wherein:

an amount of the tobacco particles is less than 2% (weight/weight) of the snus.

3. The white snus according to claim 1, wherein:

the inert carrier comprising cellulose.

4. The white snus according to claim 1, wherein:

tobacco flavor is extractable from the tobacco particles adhered on the inert carrier by saliva.

5. The white snus according to claim 1, wherein:

an amount (weight) of the nicotine source in the snus is at least 5-fold higher than an amount of the tobacco particles.

6. The white snus according to claim 1, wherein:

the tobacco particles adhered to the inert carrier comprise chemically metastable flavoring molecules, which are obtained by grinding of a tobacco source together with a liquid medium at a temperature of ≤15° C.

7. The white snus according to claim 1, further comprising:

at least 2 substances selected from a group comprising a filler material, water, humectants, cellulose, glycol, propylene glycol, glycerol, sweetener, sugar, sugar alcohol, gum, pH-adjusting agent, puffer agent, ammonia, ammonium carbonate, potassium carbonate, sodium carbonate, calcium carbonate, preservative, and salt.

8. The white snus according to claim 1, wherein:

a water content of the snus is in a range of 1-60% (w/w).

9. The white snus according to claim 1, wherein:

the tobacco particles are pasteurized.

10. The white snus according to claim 1, wherein:

the snus does not contain tobacco leaves and the tobacco particles are the only tobacco compound of the snus.

11. A method for manufacturing a white snus comprising the steps of:

providing filler material, providing a nicotine source, providing tobacco particles having a size≤30 μm adhered on an inert carrier, providing further flavorings, and mechanically mixing the ingredients.

12. The method according to claim 11, wherein:

the step of providing the tobacco particles adhered on the inert carrier to the mixture occurs during mixture of all other ingredients.

13. The method according to claim 11, further comprising:

pasteurizing the tobacco particles adhered on the inert carrier.

14. The method according to claim 13, wherein:

the pasteurizing step is performed prior to the step of providing the tobacco particles adhered on the inert carrier to the mixture of the other ingredients.

15. The method according to claim 13, wherein:

the step of pasteurizing and a step of adhering the tobacco particles on a surface of the inert carrier are performed simultaneously.

16. The method according to claim 11, wherein:

the tobacco particles adhered on the inert carrier are provided as a mixture with a humectant.

17. The method according to claim 11, further comprising:

preparing an intermediate composition by adhering the tobacco particles on a solid carrier material.

* * * * *